United States Patent [19]

Knabe

[11] 4,389,833

[45] Jun. 28, 1983

[54] BOTTLE CLOSING MACHINE HAVING BOTTLE NECK WASHING ARRAGEMENT

[75] Inventor: Uwe Knabe, Holzwickede, Fed. Rep. of Germany

[73] Assignee: Holstein und Kappert GmbH, Dortmund, Fed. Rep. of Germany

[21] Appl. No.: 196,296

[22] Filed: Oct. 14, 1980

[30] Foreign Application Priority Data

Dec. 4, 1979 [DE] Fed. Rep. of Germany ..... 2948633

[51] Int. Cl.[3] ..... B65B 7/28; B65B 61/00; B67B 3/12

[52] U.S. Cl. ..... 53/167; 53/310; 53/328; 53/331; 53/342

[58] Field of Search ..... 53/167, 328, 309, 305, 53/319, 320, 331, 310, 341, 342

[56] References Cited

U.S. PATENT DOCUMENTS

| | | | |
|---|---|---|---|
| Re. 25,962 | 2/1966 | Wheaton | 53/167 |
| 1,822,614 | 9/1931 | Darling | 53/167 X |
| 2,685,520 | 8/1954 | Martin | 53/167 X |

FOREIGN PATENT DOCUMENTS

| | | | |
|---|---|---|---|
| 78837 | 1/1955 | Denmark | 53/305 |
| 558923 | 10/1931 | Fed. Rep. of Germany | 53/167 |
| 1952579 | 4/1971 | Fed. Rep. of Germany | 53/167 |
| 754695 | 8/1956 | United Kingdom | 53/319 |

*Primary Examiner*—Horace M. Culver
*Attorney, Agent, or Firm*—Michael J. Striker

[57] ABSTRACT

An arrangement for closing containers with crown corks and the like, has a piston, a guiding opening in which the piston reciprocates, and a passage for supplying a cleaning liquid, which passage is open into an annular gap formed between the piston and the wall bounding the guiding opening. The passage may include a radial passage portion arranged to communicate with a liquid supplying conduit, and a distributing passage portion communicating with the radial passage portion.

9 Claims, 2 Drawing Figures

BOTTLE CLOSING MACHINE HAVING BOTTLE NECK WASHING ARRAGEMENT

BACKGROUND OF THE INVENTION

The present invention relates to an arrangement for closing containers with crown corks and the like.

Arrangements of the above-mentioned general type are known in the art. A known arrangement includes a closing aggregate with a cork holder and an ejecting piston movable relative to the cork holder in a guiding opening. Such arrangements are connected particularly with bottle filling machines and include a plurality of closing aggregates which are arranged circularly and close the respectively located bottles. During this process liquid rest and/or foam rest often travels in the region of the respective closing aggregate which then becomes dirty and forms ideal fertile materials for drinks damaging microorganisms, after some time. Moreover, because of unforeseeable failure, ceramic pieces or glass chips can remain on the individual parts or deposit on the upper platform or supporting face of the cork holder. During the next closing process they can be transported into a still not closed bottle.

In the German Auslegeschrift No. 2,740,440 it has been proposed to arrange a cleaner in the region of the inlet opening of the feeding passage, the cleaner being provided with an arrangement for spraying a disinfecting medium, directed against the bottle side and of the closing piston. The known spraying arrangement is stationary and directed from below against the rotary closing aggregate. Such a construction has the disadvantage in the fact that an extremely short time is available for cleaning of the dangerous region during the overrunning of the spraying arrangement. In addition to this, the liquid streams which are directed from below upwardly can reach for cleaning purposes only the surfaces which face downwardly. The strongly hazardous locations on which in time resting dirt can deposit cannot be influenced or reached by the above-described arrangement.

SUMMARY OF THE INVENTION

Accordingly, it is an object of the present invention to provide an arrangement which carries out unobjectionable cleaning and disinfection of parts associated with corks during the closing process.

More particularly, it is an object of the present invention to provide an arrangement by which foam rests tending to settle in gap region between a guiding opening and an ejecting piston can be rinsed, and which particularly provides for cleaning of supporting faces of a cork holder.

In connection with this, it is another feature of the present invention to provide an arrangement which can be utilized for a relatively long period of rinsing and arranged for rinsing a relatively great area.

In keeping with these objects and with others which will become apparent hereinafter, one feature of the present invention resides, briefly stated, in an arrangement for closing containers with crown corks and the like which comprises a cork displacing piston, a guiding means with a wall bounding a guiding opening for displacing a piston and forming a gap between the wall and the piston, wherein a means for supplying a cleaning liquid communicates with the gap between the wall of the guiding means in the region of the cork and the piston.

When the arrangement is designed in accordance with the present invention, it cleans a greater area during a longer time as compared with the known arrangements. The liquid rests or foam rests are cleaned in the region where they tend to settle.

In accordance with another feature of the present invention, the supplying means includes a radially arranged distributing openings which are provided in the ejecting piston and communicate with a supply opening which is also provided in the ejecting piston and communicates with an annular passage in the wall of the guiding means. When the ejecting piston moves upwardly, the annular passage communicates with the supply opening of the piston and cleaning liquid flows through the same into the distributing openings and thereby into the annular gap in the wall of the guiding means of the piston.

This construction has the advantage in the fact that with the movement of the ejecting piston upwardly the ringing or cleaning liquid exits first at the time when the bottle is closed or covered by a cork and thereby the cleaning liquid cannot undesirably influence the contents of the bottle. Moreover, a foam outlet which can undesirably influence the next bottle, is closed to this point of time by application of the cork. On the other hand, the arrangement carries out an automatic process inasmuch as the rinsing liquid flows outwardly only when a bottle is located below the ejecting piston.

In accordance with another feature of the present invention the liquid supply openings can be located in the wall forming the guiding opening and open into the latter. In such a construction the rinsing liquid flows from outside inwardly. In contrast, in accordance with the first-mentioned embodiment, the rinsing liquid flows from the center of the ejecting piston outwardly.

In accordance with still another feature of the present invention, the position in which the rinsing liquid flows into the annular gap between the displacing means and the piston corresponds to the upper position of the piston. More particularly, the supply opening provided in the piston communicates with the annular passage provided in the wall of the guiding means only when the ejecting piston is lifted.

In the inventive arrangement, foam rests generated during the filling of the bottles are rinsed exactly after their formation, and thereby hardening and incrusting which take place during rinsing from below when only lower parts are reached, are avoided. Moreover, the supporting surface of the crown corks in the region of the cork holder are also permanently influenced. Thereby, on the one hand, segments are rinsed without travelling to the mouth region of the next bottle, and, on the other hand, infectioning of the inner faces of the cork at the front side is avoided.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
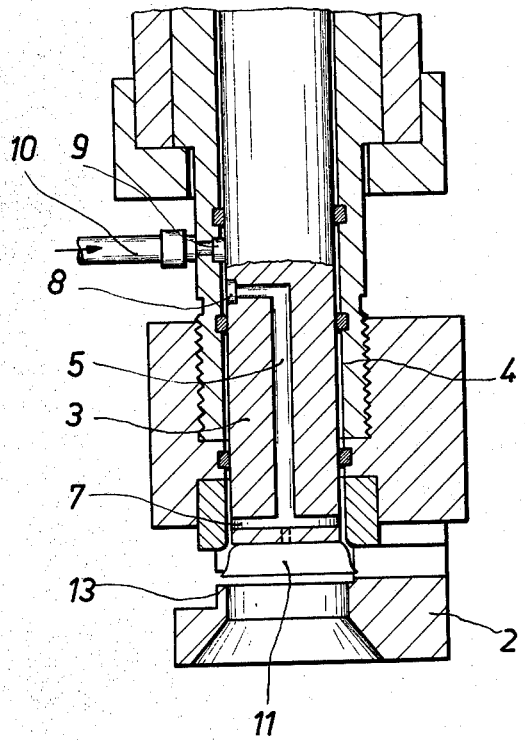
FIG. 1 is a view showing a portion of a closing aggregate in an inoperative position with a crown cork therein.

The closing aggregate is identified in toto by reference numeral 1 and includes a plurality of parts of which only the parts in the lower region are shown in the drawing. These parts include a cork holder 2 and an ejecting piston 3 associated therewith. The piston 3 reciprocates upwardly and downwardly in a guiding opening 4 which is provided in the closing aggregate 1.

The ejecting piston 3 has a central opening 5 extending substantially in an axial direction. The ejecting piston 3 is further provided with radially extending distributing openings 7 in a region 6 which is adjacent to the cork. The distributing openings 7 branches from the lower part of the central opening 5. Finally, the ejecting piston 3 is provided with a radial supply opening 8 which is located at the upper end and communicates with the upper portion of the opening 5.

The closing aggregate 1 has a circular groove 9. During reciprocation of the piston 3, it can assume a position in which the supply opening 8 of the piston communicates with the annular groove 9, and also a position in which the former does not communicate with the latter. The annular passage which is formed by the groove 9 is provided with a liquid conduit 10 which is supplied, in turn, from a not shown container of the closing arrangement. As can be seen in the drawing, a crown cork 11 is located in the cork holder 2.

The inner wall of the closing aggregate forms together with the ejecting piston 3 an annular gap. In the position shown in FIG. 1, the piston 3 is located at such a height that the supply opening 8 of the piston does not communicate with the annular groove 9. Thereby, the liquid admitted to the annular groove 9 cannot flow into the supply opening 8 and further to the distributing opening 7.

Figure 2:
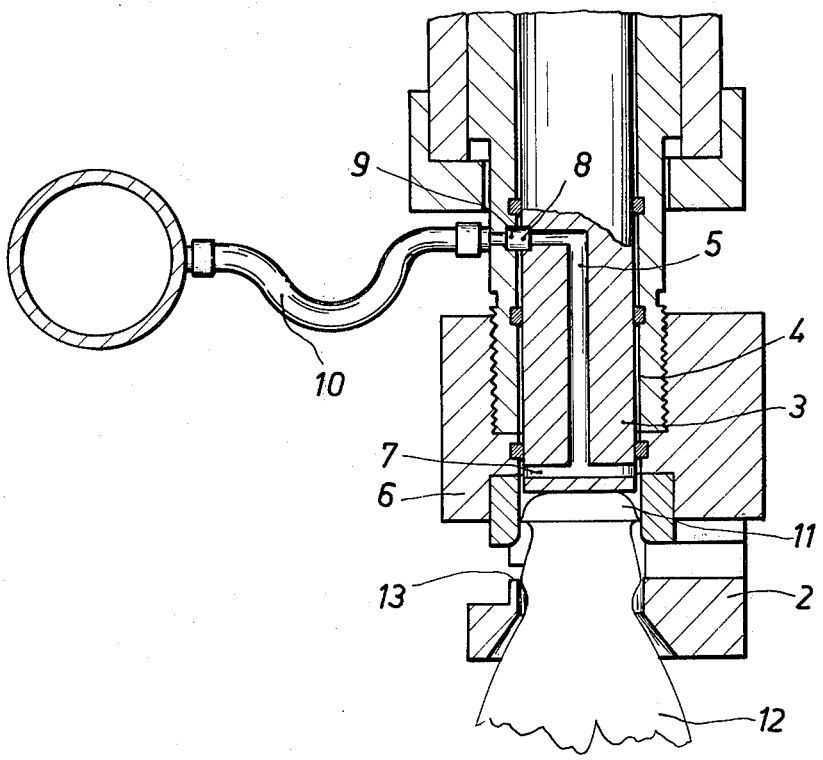
FIG. 2 is a view showing the closing aggregate in working position with a lifted ejecting piston.

FIG. 2 shows a working position of the closing aggregate. The crown cork 11 which was supported by the cork holder 2 is placed onto a bottle 12. The upper face of the crown cork 11 abuts against the lower end face of the ejecting piston 3. Thereby the ejecting piston 3 is lifted in axial direction upwardly. The supply opening 8, as a result of this, reaches the annular groove 9 of the liquid conduit 10. In this moment, the cleaning liquid and/or disinfecting liquid flows through the supply opening 8 and the distributing opening 7 into the annular gap formed between the ejecting piston 3 and the guiding opening 4 in the region of the cork. Thereby, this liquid rinses liquid rests and/or pieces and foam rests. The rinsing process can be maintained so long until a sufficient closure is attained or the closed bottle moves downwardly. In such a case, intensive cleaning during each closing process is guaranteed. Particularly, after lifing of the crown cork by the bottle 12, the supporting faces 13 of the bottle at the cork holder 2 are unobjectionably disinfected.

In accordance with a further embodiment of the invention, which is not shown in the drawing, the supply openings 7 and 8 can be provided in an outer region of the closing aggregate 1 and be open in the lower part of the guiding opening 4 against the ejecting piston 3. In such a construction, the cleaning liquid flows from outside inwardly into the annular gap formed between the wall of the closing aggregate 1 and the ejecting piston 3.

It is generally desirable to provide for only a short time action upon the respective regions of the closing aggregate 1. In connection with this, a control arrangement can be additionally provided, which can be composed of, for example, a valve which runs over a cam element.

It will be understood that each of the elements described above, or two or more together, may also find a useful application in other types of constructions differing from the types described above.

While the invention has been illustrated and described as embodied in an arrangement for closing a cork, it is not intended to be limited to the details shown, since various modifications and structural changes may be made made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. An arrangement for closing containers with crown corks and the like, comprising a substantially vertically displaceable cork-displacing piston; guiding means including an inner wall which bounds a guiding opening for displacing said piston therein, said inner wall in the region above and adjacent the cork being spaced from said piston so as to form a gap therebetween; and means for supplying a cleaning liquid and communicating with said gap at a location above the cork in response to displacement of said piston by the cork covering or closing a container, so that said gap is cleaned first above the cork and then the cork is cleaned in condition of a closed container.

2. An arrangement as defined in claim 1, wherein said piston has an axis and said guiding opening is coaxial with said piston, said gap being formed as an annular gap.

3. An arrangement as defined in claim 1, wherein said piston has an axis, said supplying means including a plurality of radially extending distributing openings each of which opens into said gap between said wall and said piston.

4. An arrangement as defined in claim 3, wherein said distributing openings are arranged in said piston.

5. An arrangement as defined in claim 1, wherein said supplying means includes a plurality of openings provided in said wall and each opening into said gap between said wall and said piston.

6. An arrangement for closing containers with crown corks and the like, comprising a cork-displacing piston having an axis; guiding means including an inner wall which bounds a guiding opening for displacing said piston therein, said inner wall in the region of the cork being spaced from said piston so as to form a gap therebetween; and means for supplying a cleaning liquid and communicating with said gap between said wall in the region of the cork and said piston, said supplying means including a plurality of radially extending distributing openings each of which opens into said gap between said wall in the region of the cork and said piston, said piston having a supply opening with an outlet communicating with said distributing openings and an inlet into which the cleaning liquid is supplied.

7. An arrangement as defined in claim 6, wherein said wall of said guiding means is provided with an annular passage communicating with a source of the cleaning liquid, said piston being displaceable between a first position in which said inlet of said supply opening is off-set relative to said annular passage and thereby the cleaning liquid does not flow from the latter into the former, and a second position in which said inlet of said supply opening communicates with said annular passage so that the cleaning liquid flows from the source through said annular passage of said wall into said supply passage of said piston and then exits from said piston through said distributing openings.

8. An arrangement as defined in claim 7, wherein said piston is displaceable in said guiding opening in an upright direction between lower and upper positions, said lower position corresponding to said first position, and said upper position corresponding to said second position.

9. An arrangement as defined in claim 6, wherein said supply opening of said piston is a radial opening.

* * * * *